US005145075A

United States Patent [19]

Johnson et al.

[11] Patent Number: 5,145,075

[45] Date of Patent: Sep. 8, 1992

[54] BOOM POINT CONSTRUCTION

[75] Inventors: Kenneth V. Johnson, Oconomowoc; James P. Piper, Oak Creek; Dale A. Beier, New Berlin, all of Wis.

[73] Assignee: Bucyrus-Erie, South Milwaukee, Wis.

[21] Appl. No.: 598,359

[22] Filed: Oct. 15, 1990

[51] Int. Cl.[5] ..... B66C 23/64; B66C 23/683; B66C 23/70; B66D 3/08

[52] U.S. Cl. ..... 212/266; 212/271; 212/252; 212/269; 254/393; 254/336; 254/413; 254/327

[58] Field of Search ..... 254/393, 414, 415, 413, 254/336, 327; 212/167, 168, 252, 271, 266

[56] References Cited

U.S. PATENT DOCUMENTS

| | | | |
|---|---|---|---|
| 3,249,238 | 2/1964 | Hedeen | 212/266 |
| 3,757,959 | 9/1973 | Thompson et al. | 254/393 |
| 4,053,139 | 10/1977 | Lovaas et al. . | |
| 4,273,067 | 6/1981 | Lloyd, III et al. | 212/190 |

OTHER PUBLICATIONS

Drawing of Heavy Duty Boom Point Section and Brochure Entitled "The Fully Hydraulic Bucyrus-Erie 65-C", Circa 1970.

Drawing E005064 dated Jan. 14, 1983 for Boom Point Box, Bucyrus-Erie Co.

Drawing L054036 dated Apr. 1987 for Boom Point Box, Bucyrus-Erie Co.

*Primary Examiner*—Joseph F. Peters, Jr.
*Assistant Examiner*—Kenneth Lee

[57] ABSTRACT

A boom point construction connects the for and aft mountings of a sheave swivel to the major structural elements of a boom. The boom point includes a framework of elongated members joined together to form a truss. The framework includes assemblies of at least three members joined together at one common point and extending in different directions from the point to define three different planes. Two of the assemblies extend from opposite sides of the front swivel support and another of the assemblies extends from the rear swivel support. A member of the assemblies from the front swivel support is connected to members of the assembly extending from the rear swivel support. The boom point is shown connecting the swivel to a boom having either three or four major longitudinal structural elements.

8 Claims, 4 Drawing Sheets

FIG. 4
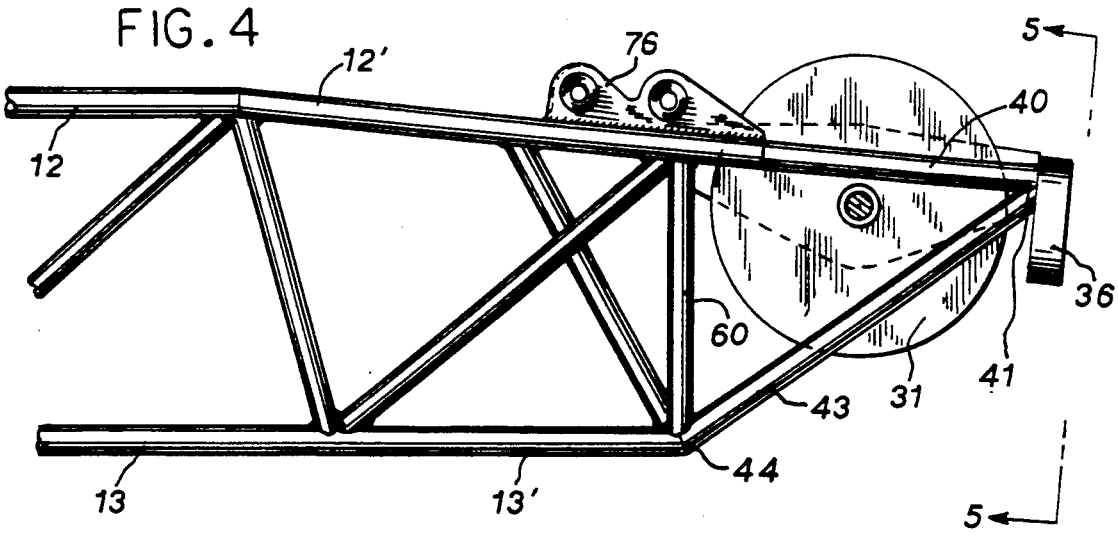
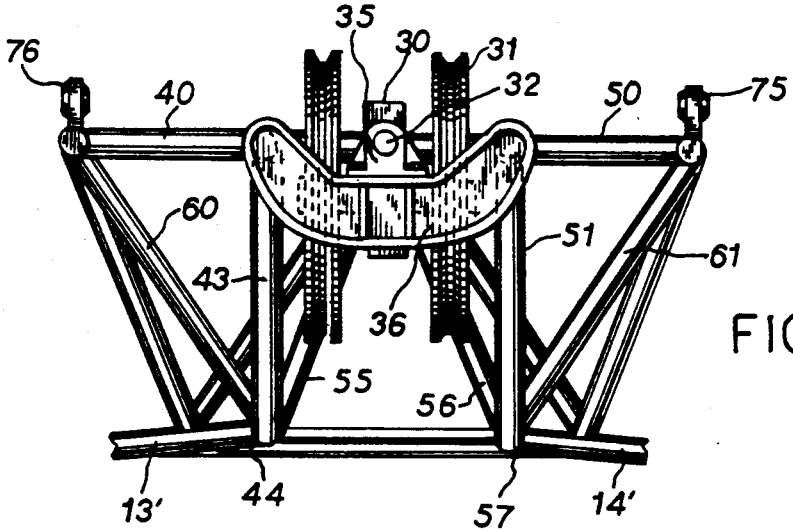
FIG. 5
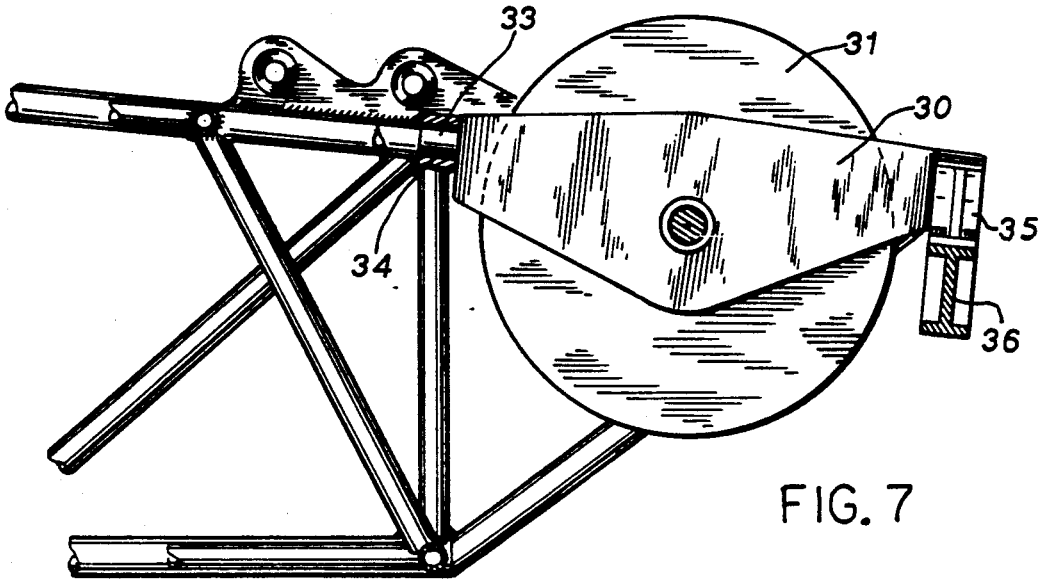
FIG. 7

BOOM POINT CONSTRUCTION

BACKGROUND OF THE INVENTION

This invention relates to a boom point, and particularly to a light-weight boom point constructed as a truss framework.

Boom points mount the sheaves or other cable carriers at the working end of a boom. Although booms have been constructed in a variety of manners, such as fabricated box beams and lattice trusses, boom points have been traditionally built up from plates into heavy box like structures. This is particularly so when the boom point is likely to experience significant side loads, such as in the boom used on a dragline.

The boom point constructions used to date contribute significantly to the weight of the boom structure. This added weight detracts from the payload that the boom can hoist and handle. Furthermore, the complex fabricated plate structures are difficult to assemble and inspect. Stress fractures may develop within the structure that are not apparent by inspection.

The present invention is directed to a boom point construction that eliminates a significant amount of the weight of prior constructions and this is accomplished by eliminating primary bending forces on the structural elements of the boom point.

SUMMARY OF THE INVENTION

A boom point according to the invention is adapted for mounting a sheave on the end of a boom that is formed of major structural elements, which can be braced by minor structural elements. The boom point includes a support for the sheave and a framework of elongated members that are joined together to form a truss connecting the sheave support to the major elements of the boom. This framework includes at least one assembly of three members that are joined together at one point to the sheave support and which extend in different directions from the point to define at least three planes.

The framework of the boom point has the elongated members joined together at nodes into a substantially triangular arrangement in all planes such that the forces on the members are coincident at the nodes and there are no primary bending forces on the framework.

The boom point of the invention has particular usefulness in dragline booms, or any other boom that encounters significant side forces caused by the lateral movement of the weight of the load being hoisted. In a dragline boom point, the sheave support preferably includes a swivel that is rotatably supported along the center line of the boom on front and rear swivel supports. The framework includes multiple assemblies of at least three members each joined together at one point and extending in different directions from such point to define at least three planes. Two of such assemblies extends from opposite sides of the front swivel support and another such assembly extends from the rear swivel support. Preferably members of the assemblies extending from the front swivel support connect to members of the assembly that extends from the rear swivel support. The framework includes additional members that triangulate the spaces between the members of the assemblies.

The boom on which the boom point is mounted may include longitudly extending stringers defining the corners of a polygonal cross section for the boom. Such stringers are major elements of the boom and the members of the assemblies connect to the stringers or longitudinal extensions of the stringers. Preferably, the members of the framework are hollow tubes that are joined together at the nodes by welding.

It is a principal object of the invention to provide a lightweight boom point.

It is another object of the invention to provide a boom point that includes a framework that carries no primary bending forces.

It is another object of the invention to provide a boom point in which all of the components are visible for visual inspection, including inspection of the junctions of the components.

The foregoing objects and advantages will appear in the detailed description that follows. In the description, reference is made to the accompanying drawings which illustrate preferred embodiments of the invention.

BRIEF DESCRIPTION OF THE DRAWINGS

FIG. 4 is a side view in elevation of the boom point of FIG. 3;

FIG. 5 is an end view in elevation of the boom point of FIG. 3;

FIG. 7 is a view in vertical section taken in the plane of the line 7—7 in FIG. 3;

DETAILED DESCRIPTION OF THE PREFERRED EMBODIMENTS

Figure 1:
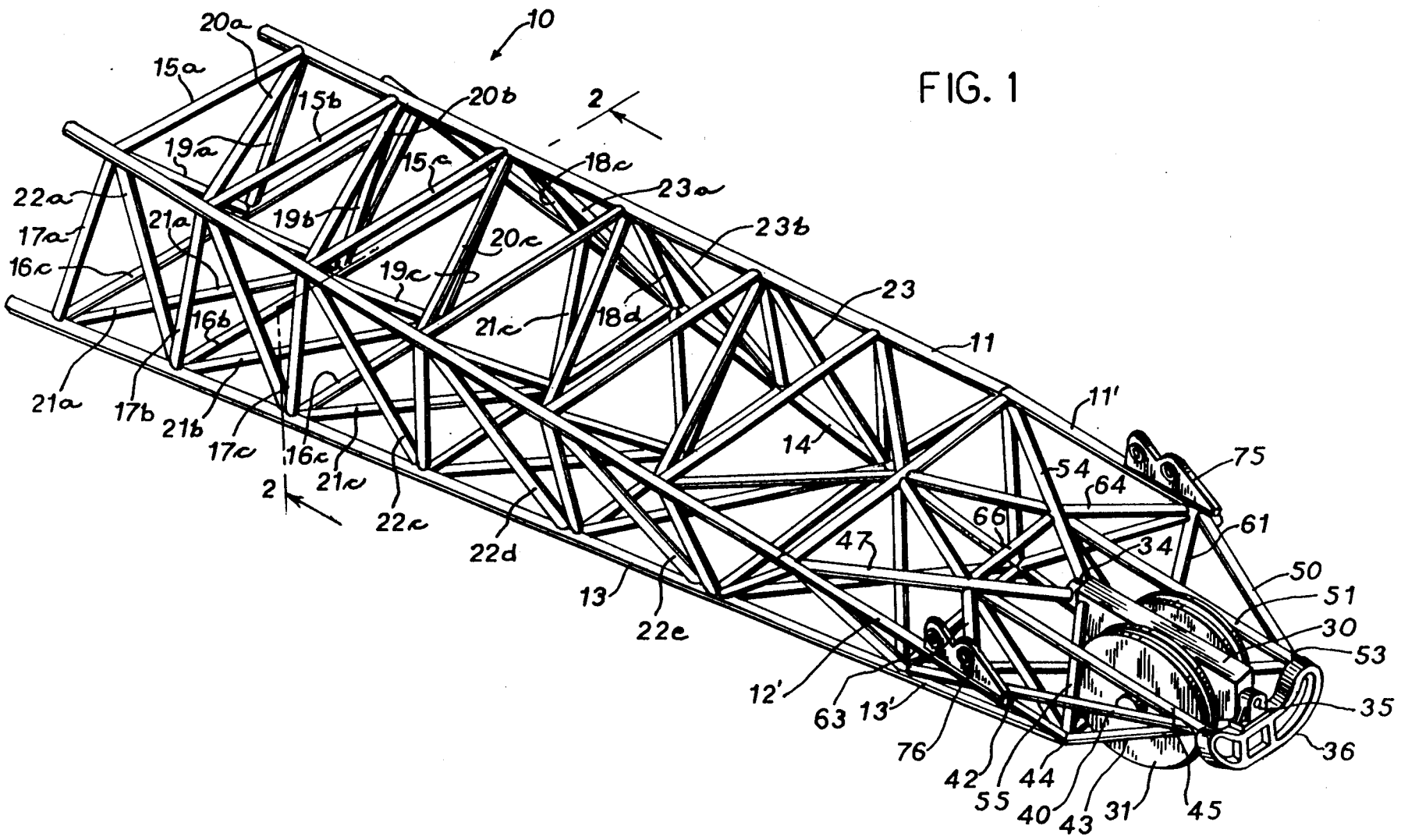
FIG. 1 is a view in perspective of a boom with a boom point according to the invention.
Figure 3:
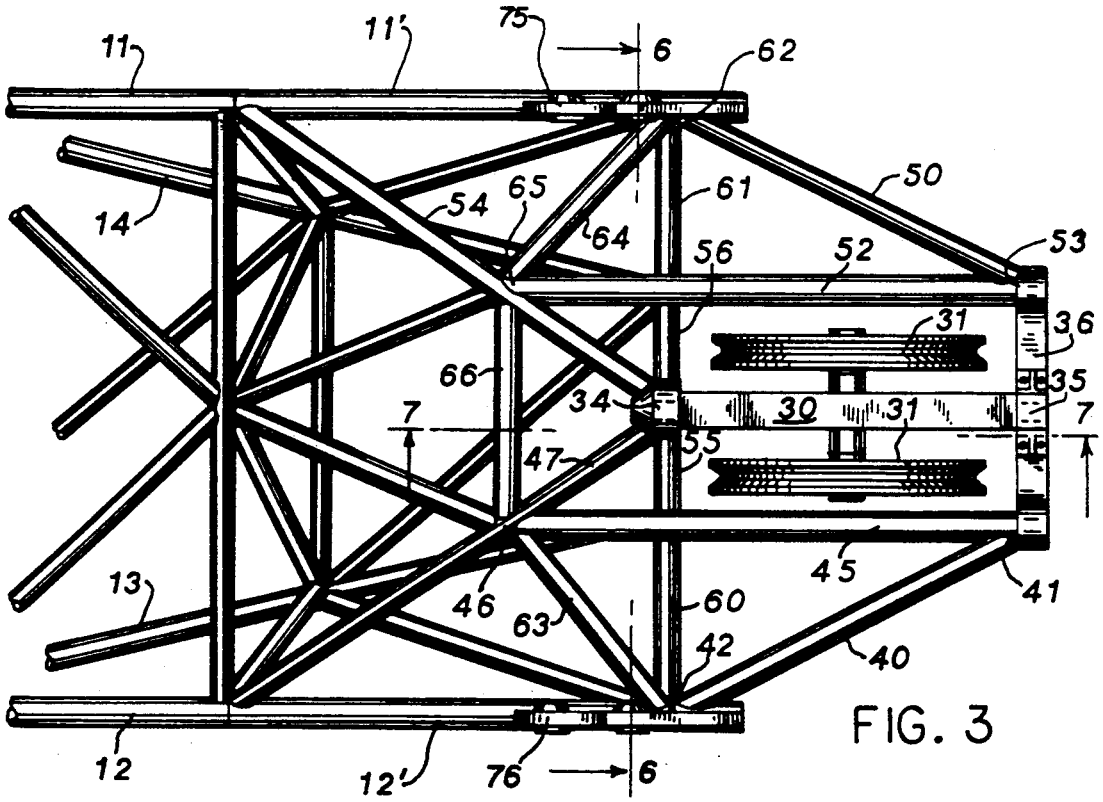
FIG. 3 is an enlarged top plan view of a portion of the boom point.
Figure 2:
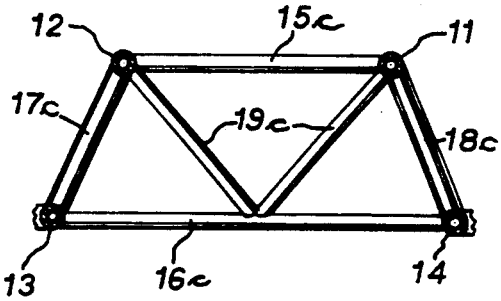
FIG. 2 is a view in vertical section through the boom and taken in the plane of the line 2—2 of FIG. 1.

FIG. 1 illustrates the boom point connected to the end of a truss-like boom 10 formed with four longitudinally extending stringers 11, 12, 13 and 14 that define the corners of a quadrilateral cross section for the boom. Stringers 11–14 form the major structural elements of the boom 10. The stringers are braced by minor structural elements which define the cross section at spaced points along the length of the boom. Each section is defined by upper and lower cross braces **15*a*, 15*b*, 15*c* et seq., and 16*a*, 16*b*, 16*c* et seq, respectively, and by side braces 17*a*, 17*b*, 17*c* et seq and 18*a*, 18*b*, 18*c* et seq. The cross section is triangulated by diagonal braces 19*a*, 19*b*, 19*c* et seq and the adjacent sections are joined by upper and lower diagonal braces 20*a*, 20*b*, 20*c* et seq, and 21*a*, 21*b*, 21*c* et seq and by diagonal side braces 22*a*, 22*b*, 22*c* et seq and 23*a*, 23*b*, 23*c***. et seq.

Such a boom construction is generally known in the art. The stringers and brace elements are typically all formed of hollow tubes with circular cross sections that are joined together at the junctions by welding. The junctions of the ends of the elements are arranged so that the center lines of the elements are coincident at any junction. Such a boom construction meets the definition of a truss in that it is formed of a rigid framework that cannot be deformed by exterior force without deformation of one or more of its elements, and the only stresses in the elements will be tension and compression. Furthermore, the boom has the desirable triangular arrangement of elements. The only bending moments which might be induced are minor and result at the junctions because the walls of the tubes are joined at points that are spaced from the center line of the elements.

The boom point construction is formed essentially as an extension of the truss framework of the boom 10. This is accomplished by creating a truss framework in the boom point that joins with the stringers 11–14 or with extensions of such stringers.

A boom point swivel 30 carries a pair of cable sheaves 31 on opposite sides. The swivel 30 is located along the center line of the boom and includes fore and aft pivot shafts 32 and 33 respectively. The rear pivot shaft 33 is received in a pivot socket 34 and the forward pivot shaft 32 is received in a pillow block bearing 35. The pillow block 35 is mounted on the top of a cross beam 36. The cross beam 36 and the pillow block 35 function as the forward support for the swivel 30, while the pivot socket 34 functions as the rearward support for the swivel 30.

The framework of the boom point comprises a plurality of hollow tubular members of circular cross section. Essential building blocks for the framework of tubular members are assemblies of at least three members each that are joined together at a point and which extend in different directions from the point to define three planes. Such assemblies of members are used in the boom point to connect the front and rear supports for the swivel 30 to the stringers or extensions of the stringers. Two such three member assemblies are joined to the opposite sides of the cross beam 36. One of the assemblies consists of a member 40 that extends from a point 41 at one side of the cross beam 36 to a junction 42 with an extension 12' of the stringer 12 at the top of the boom 10. A second member 43 of the three member assembly extends from the same point 41 at the side of the cross beam 36 to a junction 44 with an extension 13' of the stringer 13 at the bottom of the boom. The third member 45 of the assembly extends rearwardly from the point 41 on the cross beam 36 to a junction 46 with a member 47 that extends rearwardly from the rear pivot socket 34. A similar three member assembly of members 50, 51 and 52 extends from a point 53 on the other side of the cross beam 36 and connect, respectively, to an extension 11' of the upper stringer 11, an extension 14' of the lower stringer 14, and a member 54 that extends from the rear pivot socket 34.

Figure 6:
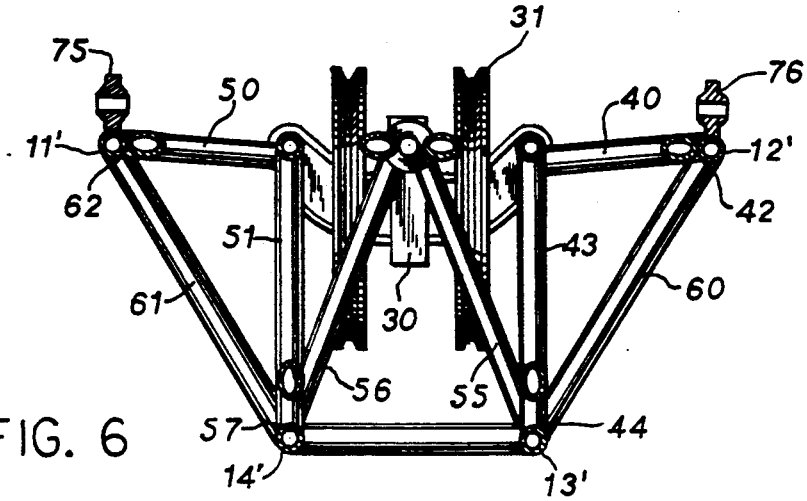
FIG. 6 is a view in vertical section taken in the plane of the line 6—6 of FIG. 3.

The members 47 and 54 which extend rearwardly from the rear pivot support 34 form two parts of another assembly of members. This assembly has four members extending from the rear pivot 34 in different directions to connect to the four stringers. The member 47 and 54 connect to the upper stringers 12 and 11, respectively. As shown is FIGS. 5 and 6, two additional members 55 and 56 connect the rear pivot support 34 to the lower stringer extensions 13' and 14'. The member 55 connects to the junction 44 of the stringer extension 13' with the member 43 from a forward assembly, and the member 56 connects to the junction 57 of the stringer extensions 14' with the member 51 from the second forward assembly.

There are additional members in the framework that divide the spaces between the stringer extensions and the assemblies of members into triangular areas for greater rigidity and stability. For example, a pair of brace members 60 and 61 extend from the junctions 44 and 57, respectively, to the junction 42 of the members 40 with the stringer extension 12' and to a junction 62 of the member 50 with the stringer extension 11', respectively. Further brace members 63 and 64 extend from the junctions 42 and 62 respectively, to the junctions 46 and 65 formed by the members 45 and 52 of the forward assemblies and the members 47 and 54 of the rear assembly. A cross member 66 extends between the junctions 46 and 65. Further cross and diagonal brace members divide the various areas into triangles as illustrated in the drawings.

The forward ends of the stringer extensions 11' and 12' also mount connection plates 75 and 76 that mount the ends of cables (not shown) that support the boom 10.

Figure 8:
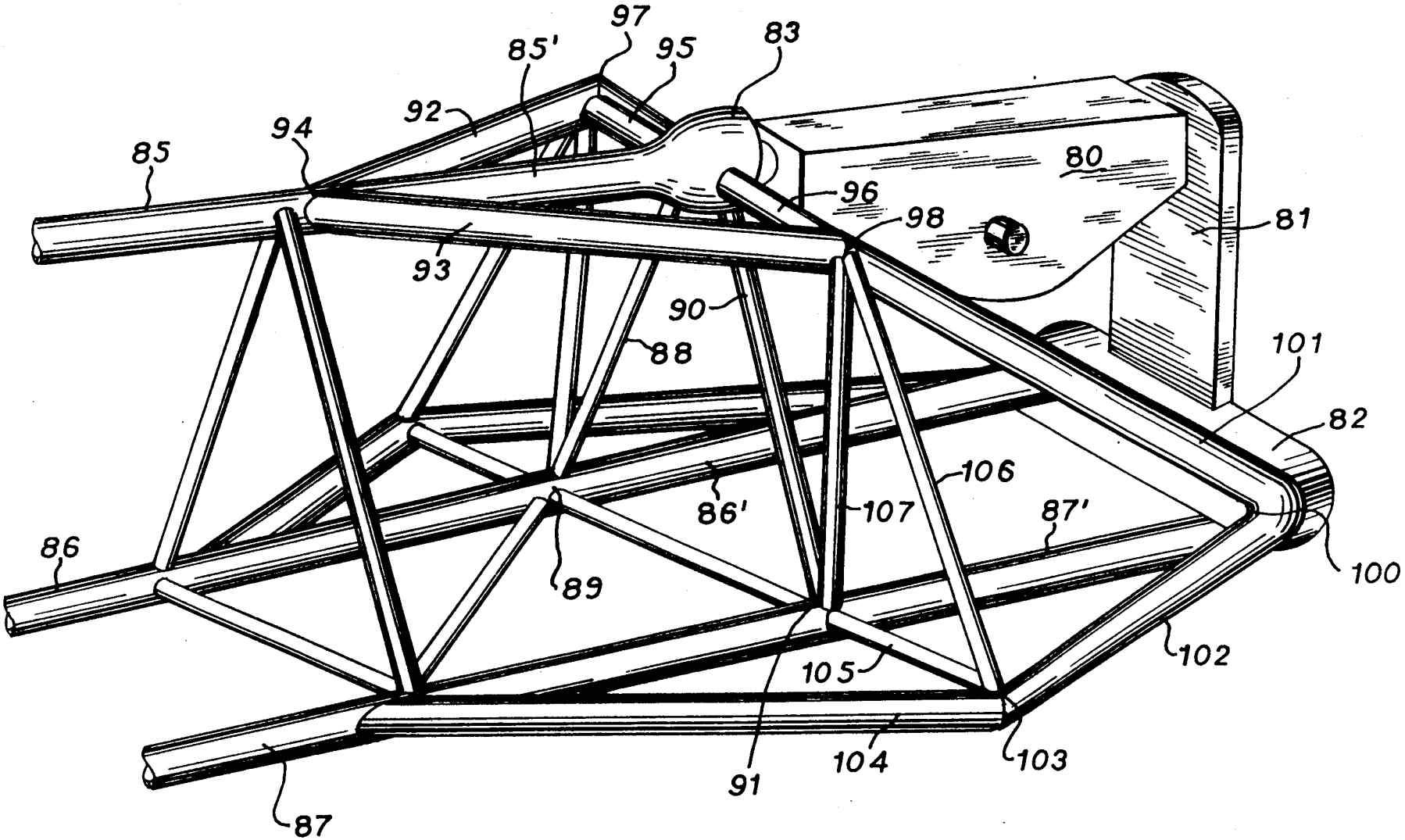
FIG. 8 is a view in perspective of another-embodiment of the boom point adapted for triangular booms.

FIG. 8 illustrates an approach to adapting the boom point construction of the present invention to a boom having a triangular cross section. The boom point has a swivel 80 the front pivot of which is mounted in a bearing in a stanchion 81 that extends upwardly from a cross beam 82. The rear pivot of the swivel 80 is mounted in a rear pivot socket 83. The sheaves have been omitted from FIG. 8 for purposes of illustration.

As in the first embodiment, the front and rear supports for the swivel 80 are connected by a truss framework, to the stringers 85, 86 and 87 that define the three corners of the triangular boom. The rear pivot socket 83 is connected by a three member assembly to the three stringers or to extensions of the stringers. The three member assembly consists of a member 85' that functions as an extension of the top stringer 85, a second member 88 that extends from the rear socket 83 to a stringer extension 86' at a junction 89, and a third member 90 that extends from the pivot point to a stringer extension 87' at a junction 91. The pivot socket 83 is also braced by an additional triangular arrangement defined by side legs 92 and 93 that are joined together to the top stringer 85 at a junction 94 and cross members 95 and 96 that respectively extend from a junction 97 with the side member 92 and a junction 98 with the side member 93.

Three members assemblies are also used to support opposite sides of the front pivot support. A point 100 at one side of the cross beam 82 joins three members that include the stringer extension 87', a second member 101 that extends to the junction 98, and a third member 102 that extends to a junction 103 with a brace member 104. The brace member 104 in turn connects to the stringer 87. A brace 105 extends between the junctions 91 and 103 and braces 106 and 107 extend from the junction 98 to the junctions 103 and 91 respectively to form a triangular array of braces. The opposite side of the cross member 82 is provided with a similar arrangement of a three member assembly and braces that divide the areas into triangles. Further tubular members divide the areas between the stringers and the members of the assemblies into triangles.

Although the cross beams used in the boom points of both embodiments are subject to primary bending forces, the members that make up the frameworks are not subjected to any significant bending moments. Instead, the forces transmitted in each framework of members are coincident at the junctions which function as nodes. Therefore, the members are subjected only to tension and compression forces. The only bending forces on the framework are secondary and result from the tubes being joined at points that are not truly on their center lines. The result is a very strong but lightweight boom point. The weight saved by the boom point construction can be transferred into an increase in the loads being hoisted and manipulated by the boom.

We claim:

1. A boom point for a dragline boom, said boom including top and bottom pairs of longitudinally extending stringers defining the corners of a quadrilateral cross section for the boom, the boom point comprising:

a boom point swivel mounting cable sheaves;

a front swivel support and a rear swivel support rotatably mounting the front and rear of the swivel along the center line of the boom; and a framework of separate elongated members joined together to form a truss connecting the swivel supports to the stringers of the boom, said framework including a longitudinally extending extension for each stringer, said framework including an assembly of four members joined together at the rear swivel support, and extending therefrom in different directions to each connect to a respective stringer extension, said framework including a pair of assemblies of three members with the members of each assembly joined together on opposite sides of the front swivel support and extending therefrom in different directions, two of the members of each three member assembly being connected to a top and bottom stringer extension and the third member of the three member assembly being connected to a respective one of the members of the four member assembly, and said framework also including additional members that triangulate the spaces between the members of the assemblies and the stringer extensions.

2. A boom point for mounting a sheave swivel on the end of a boom, said boom being formed of major structural elements braced by minor structural elements, the boom point comprising:

a support for the sheave including front and rear swivel supports for pivotally mounting the swivel; and a framework of elongated members joined together to form a truss connecting front and rear swivel supports to major elements of the boom, the framework including at least one assembly of three members joined together at a common point to the sheave support and extending in different directions from the point to define at least three different planes.

3. A boom point in accordance with claim 1 wherein the framework includes a three member assembly extending from each opposite side of the sheave support.

4. A boom point in accordance with claim 2 wherein the sheave support is a swivel that is pivotally mounted fore and aft along the centerline of the boom, and the framework includes three member assemblies at the fore and aft mounting of the swivel.

5. A boom point in accordance with claim 4 wherein a member of a fore three member assembly is connected to a member of the aft three member assembly.

6. A boom point for a dragline boom, said boom being formed of major structural elements braced by minor structural elements, the boom point comprising:

a boom point swivel mounting cable sheaves;

a front swivel support and a rear swivel support rotatably mounting the front and rear of the swivel; and a framework of elongated members joined together to form a truss connecting the front and rear swivel supports to the major elements of the boom, said framework including assemblies of at least three members joined together at a common point and extending in different directions from such point to define at least three different planes, two of said assemblies extending from opposite sides of the front swivel support and another of said assemblies extending from the rear swivel support.

7. A boom point in accordance with claim 6 wherein one member of each of the assemblies extending from the front swivel support is connected to a respective one of the members of the assembly extending from the rear swivel support.

8. A boom point for a dragline boom, said boom including major structural elements, the boom point comprising:

a boom point swivel mounting cable sheaves;

a front swivel support and a rear swivel support rotatably mounting the front and rear of the swivel; and a framework of individual elongated members joined together at nodes into a substantially all triangular arrangement in all planes defined by the elongated members, said framework connecting the front and rear swivel supports to the major elements of the boom, and the forces on said members being coincident at the node so that there are no primary bending forces on the framework.

* * * * *

UNITED STATES PATENT AND TRADEMARK OFFICE

CERTIFICATE OF CORRECTION

PATENT NO. : 5,145,075

DATED : Sep. 8, 1992

INVENTOR(S) : Kenneth V. Johnson, et al.

It is certified that error appears in the above-identified patent and that said Letters Patent is hereby corrected as shown below:

Col. 6, Line 3 (claim 3) change "claim 1" to --claim 2--.

Signed and Sealed this

Nineteenth Day of October, 1993

*Attest:*

Bruce Lehman

BRUCE LEHMAN

*Attesting Officer*

*Commissioner of Patents and Trademarks*